US010240599B2

(12) United States Patent
Tanaka

(10) Patent No.: US 10,240,599 B2
(45) Date of Patent: Mar. 26, 2019

(54) UNIAXIAL ECCENTRIC SCREW PUMP

(71) Applicant: HEISHIN Ltd., Hyogo (JP)

(72) Inventor: Kei Tanaka, Kobe (JP)

(73) Assignee: HEISHIN LTD., Kobe-Shi (JP)

( * ) Notice: Subject to any disclaimer, the term of this patent is extended or adjusted under 35 U.S.C. 154(b) by 36 days.

(21) Appl. No.: 15/114,767

(22) PCT Filed: Dec. 4, 2014

(86) PCT No.: PCT/JP2014/082142
§ 371 (c)(1),
(2) Date: Jul. 27, 2016

(87) PCT Pub. No.: WO2015/114945
PCT Pub. Date: Aug. 6, 2015

(65) Prior Publication Data

US 2016/0341196 A1 Nov. 24, 2016

(30) Foreign Application Priority Data

Jan. 28, 2014 (JP) ..... 2014-013541

(51) Int. Cl.

| | |
|---|---|
| ***F01C 1/10*** | (2006.01) |
| ***F01C 5/00*** | (2006.01) |
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/107*** | (2006.01) |
| ***F04C 15/00*** | (2006.01) |

(52) U.S. Cl.
CPC ..... *F04C 2/1075* (2013.01); *F04C 2/107* (2013.01); *F04C 15/0015* (2013.01); *F04C 2210/44* (2013.01); *F04C 2240/10* (2013.01); *F04C 2240/20* (2013.01); *F04C 2240/30* (2013.01)

(58) Field of Classification Search
CPC .. F04C 2/1071; F04C 2/1075; F04C 15/0015; F04C 2210/44; F04C 2240/10; F04C 2240/20; F04C 2240/30; F05C 2225/00; F05C 2225/02; F05C 2225/04; F05C 2253/20
USPC ..... 418/48, 152, 153, 179
See application file for complete search history.

(56) References Cited

U.S. PATENT DOCUMENTS 6,457,958 B1 * 10/2002 Dunn ..... F04C 2/1071 418/48
2010/0196182 A1 8/2010 Loeker et al.
(Continued)

FOREIGN PATENT DOCUMENTS

EP 2660471 A1 11/2013
JP 2003-042075 A 2/2003
(Continued)

*Primary Examiner* — Theresa Trieu
(74) *Attorney, Agent, or Firm* — Baker & Hostetler LLP

(57) ABSTRACT

A uniaxial eccentric screw pump includes: a casing; a stator having one end portion thereof connected to the casing and having an inner peripheral surface which is formed into a female threaded shaped; a rotor configured to be insertable into the stator and formed of a shaft body having a male threaded shape; and an end stud connected to the other end portion of the stator. The stator is configured to be expandable and shrinkable in a radial direction.

11 Claims, 8 Drawing Sheets

(56) References Cited

U.S. PATENT DOCUMENTS

| | | | | |
|---|---|---|---|---|
| 2010/0284843 | A1* | 11/2010 | Jager | F04C 2/1071 418/48 |
| 2011/0020160 | A1 | 1/2011 | Wautelet et al. | |
| 2013/0108412 | A1* | 5/2013 | Hashima | F04C 2/1075 415/72 |

FOREIGN PATENT DOCUMENTS

| | | | | |
|---|---|---|---|---|
| JP | 2008-069896 | A | 3/2008 | |
| JP | 2010-537095 | A | 12/2010 | |
| JP | 2011-027108 | A | 2/2011 | |
| JP | 2012-137038 | A | 7/2012 | |
| JP | 2013-011186 | A | 1/2013 | |
| WO | WO-0144615 | A2 * | 6/2001 | F04C 2/1075 |
| WO | WO 2009/024279 | A1 | 2/2009 | |

* cited by examiner

UNIAXIAL ECCENTRIC SCREW PUMP

CROSS-REFERENCE TO RELATED APPLICATIONS

This is a National Stage application of International Patent Application No. PCT/JP2014/082142, filed on Dec. 4, 2014, which claims priority to Japanese Patent Application No. 2014-013541 filed on Jan. 28, 2014, the disclosures of which are incorporated herein by reference in their entireties.

TECHNICAL FIELD

The present disclosure relates to a uniaxial eccentric screw pump.

BACKGROUND ART

Conventionally, as a uniaxial eccentric screw pump, there has been known a uniaxial eccentric screw pump having the configuration where a stator is formed of a stator body and an outer sleeve, and the outer sleeve can be easily split from the stator body (see Japanese Unexamined Patent Application Publication No. 2012-137038, for example).

In such a conventional uniaxial eccentric screw pump, there may be a case where an internal surface of the stator body is cleaned and sterilized simultaneously with the supply of a high-temperature fluid such as vapor or hot water into the stator body. In this case, the stator body expands. However, the deformation of the stator body toward an outer diameter side is prevented by the outer sleeve and hence, a displacement amount toward an inner diameter side, that is, interference (overlapping between an outer surface of a rotor and an inner surface of the stator) is increased. When the rotor is rotated in such a state, a frictional force of the rotor against the stator body becomes excessively large and hence, there may be a case where an abnormal wear occurs on the stator body or the rotor is damaged. Further, there may be also a possibility that the rotor cannot be rotated. Accordingly, interference is adjusted by disposing a shim between the stator body and the outer sleeve.

However, such an interference adjusting operation is a complicated and cumbersome operation which must be performed manually. Further, it is necessary to perform the interference adjusting operation each time an operation mode (a normal operation and a cleaning operation) is switched. Accordingly, there has been a demand for the improvement of the interference adjusting operation.

SUMMARY

Problems to be Solved

It is an object of the present disclosure to provide a uniaxial eccentric screw pump the stator inside of which can be cleaned and sterilized at high temperature without requiring a complicated and cumbersome adjusting operation while preventing the occurrence of abnormal wear on the stator which may be caused by the rotation of a rotor.

Means for Solving the Problems

The present disclosure provides, as a means of solving the problems, a uniaxial eccentric screw pump which includes:

a casing;

a stator having one end portion thereof connected to the casing and having an inner peripheral surface which is formed into a female threaded shape;

a rotor configured to be insertable into the stator and formed of a shaft body having a male threaded shape; and an end stud connected to the other end portion of the stator, wherein the stator is configured to be expandable and shrinkable in a radial direction.

With such a configuration, even when a fluid of a high temperature is made to flow through the uniaxial eccentric screw pump, the stator is expandable in the outer diameter direction and hence, it is possible to prevent the stator from being brought into pressure contact with the rotor due to the expansion of the stator toward an inner diameter side. Accordingly, even when the rotor is relatively rotated about an axis thereof with respect to the stator without adjusting interference of the stator with the rotor, it is possible to prevent the occurrence of a phenomenon that a contact pressure between the rotor and the stator is increased so that the interference becomes large more than necessary. That is, the occurrence of abnormal wear on the stator can be suppressed without requiring a cumbersome adjusting operation.

It is preferable that the stator include the closure structure which at least prevents intrusion of a foreign substance from the outside at a junction between one end portion and the casing and at a junction between the other end portion and the end stud.

With such a configuration, due to the provision of the closure structure, there is no possibility that various germs contained in ambient atmosphere intrude into the inside of the stator and hence, the environment after cleaning can be maintained. It is unnecessary to disassemble the stator and hence, operability of the uniaxial eccentric screw pump can be enhanced.

It is preferable that the closure structure be a seal structure which prevents leakage of a fluid material toward the outside from both end portions of the stator.

With such a configuration, both during a normal operation and during a cleaning operation, air-tightness can be maintained. Accordingly, even when a fluid material to be conveyed is a chemical or the like, there is no possibility that the fluid material leaks to the surrounding of the uniaxial eccentric screw pump and contaminates the surrounding.

It is preferable that the stator is formed of: a stator body made of a rubber material; and an outer sleeve disposed on an outer peripheral portion of the stator body in an adhesion state, and made of a resin material harder than the rubber material during a normal operation.

With such a configuration, during a normal operation, the deformation of the stator body is suppressed by the hard outer sleeve so that proper interference can be maintained and hence, a fluid material can be conveyed at a desired discharge pressure due to the rotation of the rotor.

The stator may be formed of only the stator body.

It is preferable that the seal structure include:

a first flange portion and a second flange portion formed on both end portions of the stator respectively;

a third flange portion formed on the end stud and brought into contact with the flange portion on one end portion of the stator;

a fourth flange portion formed on the casing and brought into contact with the flange portion on the other end portion of the stator;

a first clamp configured to clamp the first flange portion and the third flange portion to each other; and a second clamp configured to clamp the second flange portion and the fourth flange portion to each other.

With such a configuration, a desired seal state can be acquired by the flange portion and the clamp. Further, the stator can be easily exchanged by simply removing the clamp.

It is preferable that an adaptor made of a metal material be mounted on both end portions of the stator, and the respective adaptors form the first flange portion and the second flange portion respectively.

With such a configuration, the flange portion can be easily formed on the stator having the complicated inner surface structure. Further, when it is necessary to exchange the stator due to wear, the adaptor can be reused by removing from the stator.

It is preferable that the seal structure include a stay bolt which connects the casing and the end stud to each other.

With such a configuration, the stator can be clamped between the casing and the end stud and hence, a desired seal state can be obtained.

It is preferable that the uniaxial eccentric screw pump include a spacer which is mounted on the stay bolt from the outside, is brought into contact with the casing and the end stud respectively, and maintains the casing and the end stud with a fixed distance therebetween.

With such a configuration, the distance between the casing and the end stud is maintained at a fixed distance and hence, the stator can be clamped in a desired compression state. Accordingly, the uniaxial eccentric screw pump can ensure a desired sealing property while suppressing the expansion of the stator toward an outer diameter side.

Effect of the Disclosure

According to the present disclosure, even when a heated fluid is made to flow in the stator without disassembling the stator, the stator expands in the outer diameter direction and hence, it is possible to prevent the stator from being brought into pressure contact with the rotor disposed in the inside of the stator. Accordingly, there is no possibility that abnormal wear occurs on the stator, and the heated fluid is smoothly conveyed in the stator due to the rotation of the rotor and hence, the stator can be cleaned and sterilized. At this stage of operation, it is unnecessary to disassemble the stator and hence, there is no possibility that various germs contained in ambient atmosphere intrude into the inside of the stator whereby a sterilizing effect can be maintained. Further, in a normal operation, it is unnecessary to set a margin with respect to a gap formed between the inner surface of the stator and an outer surface of the rotor and hence, a fluid material can be efficiently conveyed at a desired discharge pressure.

BRIEF DESCRIPTION OF THE DRAWINGS

The foregoing and the other feature of the present disclosure will become apparent from the following description and drawings of an illustrative embodiment of the disclosure in which.

MODE FOR CARRYING OUT THE DISCLOSURE

Hereinafter, embodiments according to the present disclosure are described with reference to attached drawings. In the description made hereinafter, terms indicating specific directions and positions (terms including "upper", "lower", "side", and "end", for example) are used when necessary. However, these terms are used for facilitating the understanding of the disclosure described with reference to the drawings, and the technical scope of the present disclosure is not limited by the meaning of these terms. Further, the description made hereinafter essentially only exemplifies examples of the present disclosure, and the description is not intended to limit the present disclosure, a product to which the present disclosure is applied, or the application of the present disclosure. Further, drawings are schematically shown, and the size ratios of respective parts and the like differ from those of actual parts.

Figure 1A:
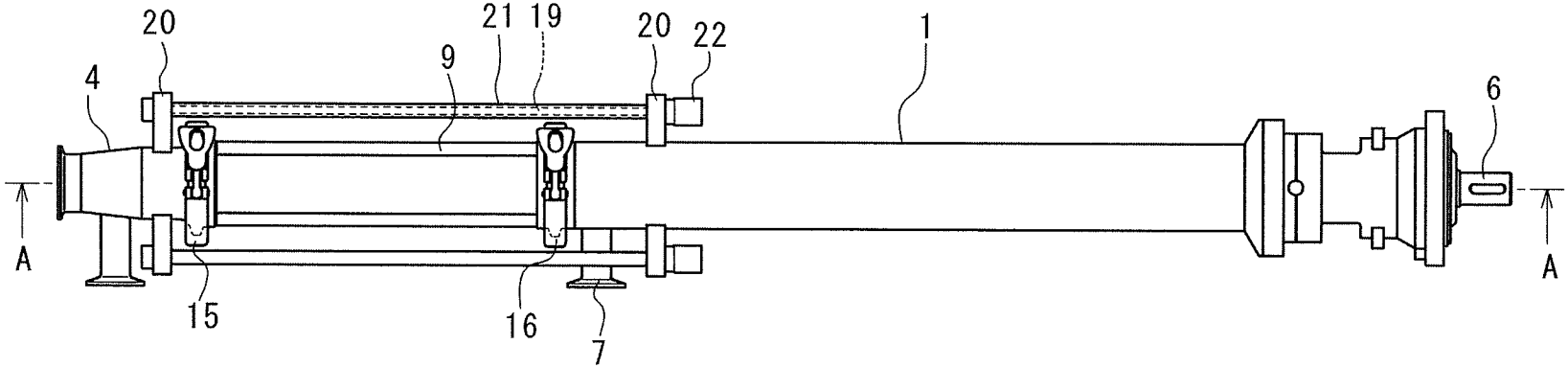
FIG. 1(*a*) is a schematic plan view of a uniaxial eccentric screw pump according to this embodiment, and FIG. 1(*b*) is a cross-sectional view taken along a line A-A in FIG. 1(*a*).
Figure 1B:
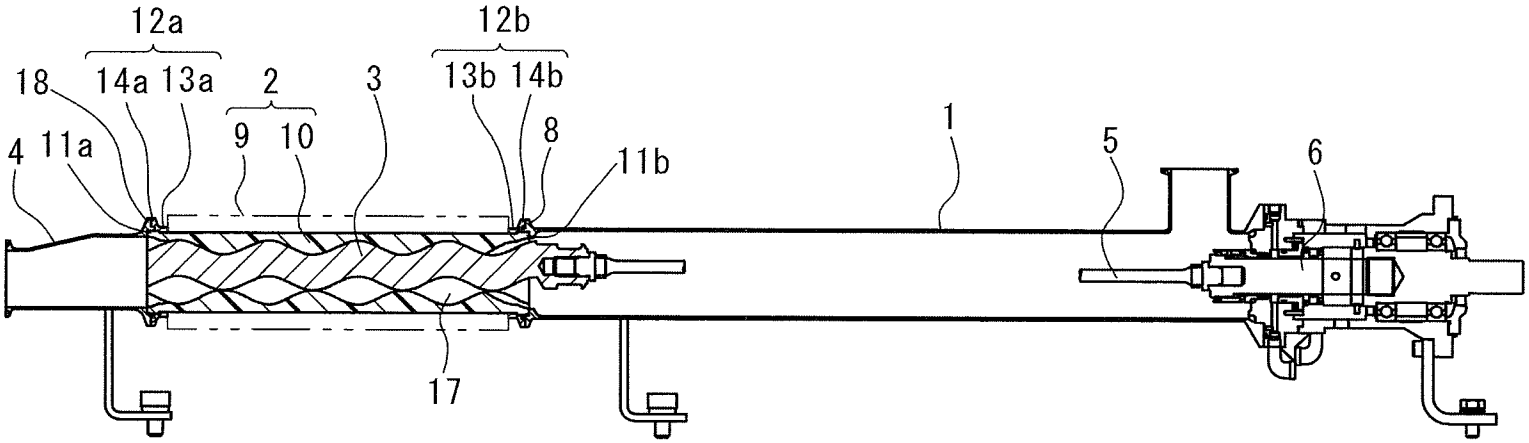

FIG. 1 shows a uniaxial eccentric screw pump according to this embodiment. The uniaxial eccentric screw pump includes: a drive unit (not shown) disposed on one end side of a casing 1; a stator 2 disposed on the other end side of the casing 1; a rotor 3; and an end stud 4.

Figure 5:
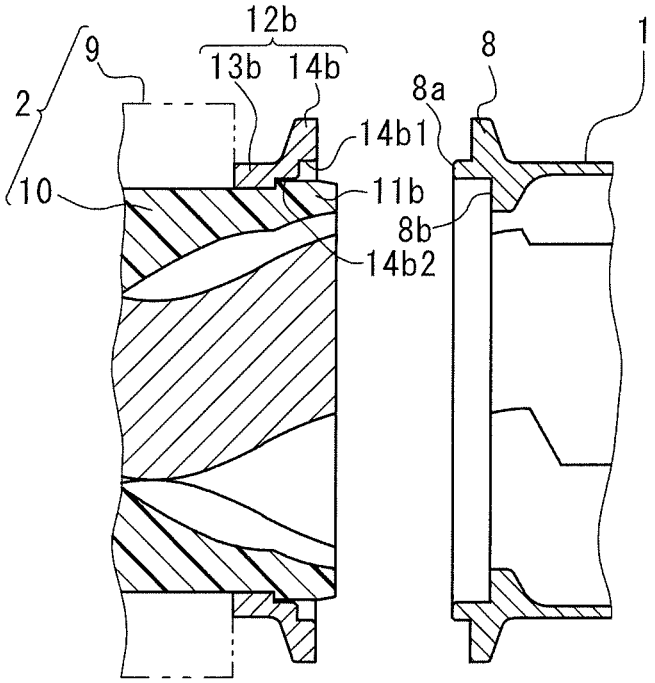
FIG. 5 is an enlarged cross-sectional view showing a state where a casing and a stator shown in FIG. 1(*b*) are in a disassembled state.

The casing 1 is a cylindrical body made of a metal material, and a coupling rod 5 is housed in the casing 1. One end portion of the coupling rod 5 is connected to a coupling 6, and power from the drive unit is transmitted to the coupling rod 5. A connecting pipe 7 is connected to an outer peripheral surface of the casing 1 on one end side, and a fluid material (for example, a material and the like having viscosity such as mayonnaise) can be supplied to the casing 1 from a tank or the like not shown in the drawing. Further, a fourth flange portion 8 extending toward an outer diameter side is formed on an opening portion on the other end of the casing 1. As shown in FIG. 5, an annular projecting portion 8*a* which projects from an end surface of the fourth flange portion 8 is formed on an inner peripheral edge portion of the fourth flange portion 8. An annular recessed portion 8*b* is formed on the annular projecting portion 8*a* within a predetermined range from a distal end portion in an axial direction.

The stator 2 is formed of: an outer sleeve 9; and a stator body 10 disposed in a state where the stator body 10 is brought into close contact with an inner surface of the outer sleeve 9.

The outer sleeve 9 is made of an elastically deformable (or thermally expandable) resin material (for example, PEEK (polyetheretherketone), PTFE (polytetrafluoroethylene), POM (polyacetal) or the like). As described later, when heated water vapor or the like flows in the inside of the stator body 10 so that the stator body 10 expands toward an outer diameter side, the outer sleeve 9 can expand along with such expansion of the stator body 10. Here, as a material for forming the outer sleeve 9, a material harder than at least a rubber material which forms the stator body 10 at a temperature in a normal use state where a fluid material is conveyed by the uniaxial eccentric screw pump is used. With such a configuration, at the time of conveying the fluid material by rotating the rotor 3, it is possible to obtain a desired discharge pressure by preventing deformation of the stator body 10 and by maintaining a proper interference.

The stator body 10 is formed of a cylindrical body (for example, circular cylindrical body) made of an elastic material such as rubber or a resin which is selected as desired corresponding to a material to be conveyed (for example, silicon rubber, or a fluoro-rubber when the stator body 10 is used for cosmetics or the like containing silicon oil). An inner peripheral surface of a center hole of the stator 2 is formed into a single-stage or multi-stage female threaded shape of n-thread. On both end portions of the stator body 10, ring portions 11*a*, 11*b* having a slightly large outer diameter size respectively are formed, and adaptors 12*a*, 12*b* are respectively mounted on the stator body 10 by making use of these ring portions 11*a*, 11*b*.

The adaptors 12*a*, 12*b* are made of a metal material such as stainless steel, and each adaptor 12*a*, 12*b* is formed of a cylindrical portion 13*a*, 13*b* and a first flange portion 14*a* and a second flange portion 14*b* which projects toward an outer diameter side from one end of the cylindrical portion 13*a*, 13*b*. On each flange portion 14*a*, 14*b*, a first annular recessed portion 14*a*1, 14*b*1 and a second annular recessed portion 14*a*2, 14*b*2 which has an inner diameter size smaller than that of the first annular recessed portion 14*a*1, 14*b*1 are formed in this order from an end surface of the flange portion 14*a*, 14*b*. Since the stator body 10 is made of an elastic material, the adaptors 12*a*, 12*b* can be mounted on the stator body 10 by elastically deforming the ring portions 11*a*, 11*b* toward an inner diameter side.

Figure 2:
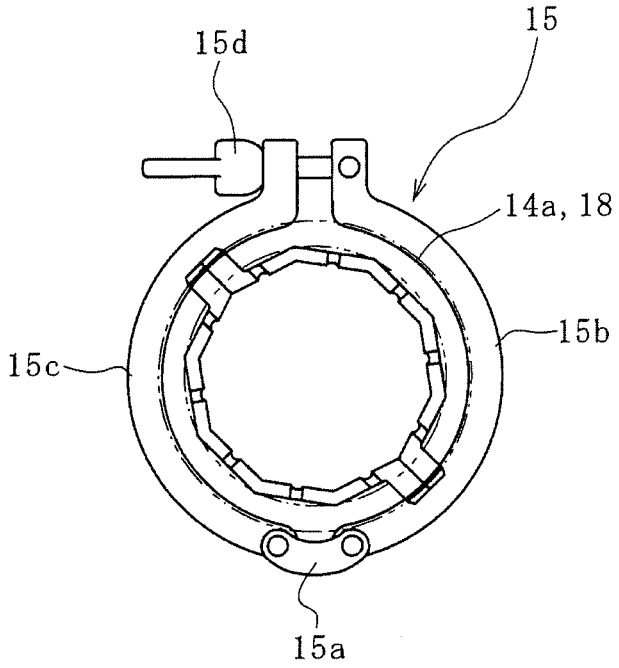
FIG. 2 is a schematic front view showing a clamp shown in FIG. 1.

The adaptor 12*a* is held by a first clamp 15 in a state where the first flange portion 14*a* is brought into contact with a third flange portion 18 of the end stud 4 described later. As shown in FIG. 2, the first clamp 15 is formed of a pair of semicircular clamp portions 15*b*, 15*c* which is rotatably connected to a pivotally supporting portion 15*a*. The first clamp 15 further includes a clip portion 15*d* which fixes both clamp portions 15*b*, 15*c* so as to form an annular shape. Both clamp portions 15*b*, 15*c* hold the first flange portion 14*a* of the adaptor 12*a* and the third flange portion 18 of the end stud 4 by an annular groove (not shown) formed on inner peripheral surfaces of the clamp portions 15*b*, 15*c* in an annular shape. On the other hand, the adaptor 12*b* is held by a second clamp 16 having substantially the same configuration as the first clamp 15 in a state where the second flange portion 14*b* of the adaptor 12*b* is brought into contact with the fourth flange portion 8 of the casing 1. Both the first clamp 15 and the second clamp 16 are made of substantially the same metal material (in this embodiment, stainless steel) as the adaptors 12*a*, 12*b*. That is, the adaptors 12*a*, 12*b* and the first and second clamps 15, 16 which are made of substantially the same hard material can be brought into direct contact with each other. Accordingly, unlike the case where the stator body made of a resin, a rubber material or the like and the first clamp 15 or the second clamp 16 made of a metal material are brought into direct contact with each other, in this embodiment, there is no deformed portion and hence, a state where the adaptors 12*a*, 12*b* are held by the first and second clamps 15, 16, respectively, can be held in a stable manner. Therefore, the positional displacement of these portions at the connecting portions can be prevented. Accordingly, a pressure contact state of the stator body 10 which is made of soft rubber or a resin material with respect to the flange portions 14*a*, 14*b* of the adaptors 12*a*, 12*b*, the fourth flange portion 8 of the casing 1 and the third flange portion 18 of the end stud 4 all of which are made of a hard metal material can be brought into a desired state. As a result, air-tightness of the respective connecting portions can be maintained and hence, both during a normal operation and during a cleaning operation, it is possible to prevent leakage of a liquid and intrusion of various germs brought about by the exposure of the connecting portions to ambient atmosphere.

Figure 11A:
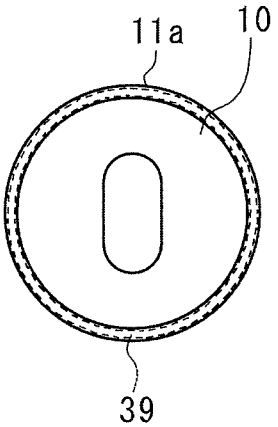
FIG. 11(*a*) is a side view showing one end portion of a stator body according to another embodiment, and FIG. 11(*b*) is a cross-sectional front view showing a portion of one end portion of the stator body.
Figure 11B:
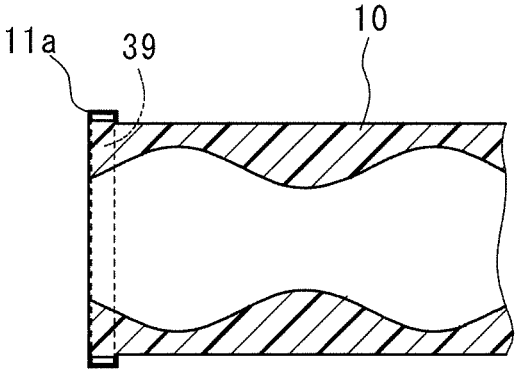

As shown in FIG. 11, a metal-made ring 39 may be incorporated in the ring portions 11*a*, 11*b* formed on both end portions of the stator body 10 respectively (only a ring portion 11*a* side shown in FIG. 11). With such a configuration, a clamping state acquired by the clamps 15, 16 can be further strengthened thus further enhancing air-tightness of the junctions. Further, in addition to the configuration where the metal-made ring 39 and the metal-made adaptors 12*a*, 12*b* are used in combination, by imparting a function of the adaptor 12*a* or 12*b* to the ring 39, at least either one of the adaptors 12*a* or 12*b* can be omitted.

The rotor 3 is formed by forming a shaft body made of a metal material into a single-stage or multi-stage male threaded shape of n−1 threads. The rotor 3 is disposed in the inside of the center hole of the stator 2, and a conveyance space 17 continuously connected in a longitudinal direction of the center hole is formed. One end portion of the rotor 3 is connected to the coupling rod 5 on a casing side. The rotor 3 rotates in the stator 2 and, at the same time, revolves along the inner peripheral surface of the stator 2 by a drive force from the drive unit (not shown). That is, the rotor 3 eccentrically rotates in the center hole of the stator 2 and hence, the rotor 3 can convey a material in the conveyance space 17 in a longitudinal direction.

The end stud 4 is formed of a cylindrical body made of a metal material. The flange portion 18 which extends outward is formed on an opening portion of the end stud 4 at one end of the end stud 4. The flange portion 18 is held by the first clamp 15 in a state where the flange portion 18 is brought into contact with the flange portion 14*a* of the adaptor 12*a* as described previously. An annular projecting portion 18*a* and an annular recessed portion 18*b* are formed on an end surface of the flange portion 18 in the same manner as the casing 1.

The end stud 4 and the casing 1 are connected to each other by stay bolts 19. That is, support members 20 are formed on an outer peripheral surface of the end stud 4 and on an outer peripheral surface of the casing 1 respectively in a state where the support members 20 are disposed at two positions in point symmetry with respect to an axis. The stay bolts 19 are made to pass through the support members 20 of the end stud 4 and the casing 1 respectively in a state where a cylindrical spacer 21 made of a metal material (for example, stainless steel) is mounted on each stay bolt 19 from outside, and a nut 22 is threadedly engaged with one end portion of each stay bolt 19. By fastening the nut 22, the stator 2 is clamped between the end stud 4 and the casing 1. In such a state, a distance between the end stud 4 and the casing 1 can be maintained at a fixed value by the spacer 21. Accordingly, there is no possibility that the stator body 10 is compressed more than necessary so that the stator body 10 is clamped between the end stud 4 and the casing 1 in a desired compression state. In this manner, due to the presence of the spacers 21, there is no possibility that the stator body 10 is compressed more than necessary or a gap is formed at both end portions of the stator body 10. On the other hand, since the outer sleeve 9 is sufficiently hard compared to the stator body 10, in the case where the outer sleeve 9 can play a role of maintaining the distance between the end stud 4 and the casing 1 at a fixed value, the spacers 21 are not always necessary.

Hereinafter, the connection between the casing 1 and the stator 2 and the connection between the stator 2 and the end stud 4 are described in detail with reference to FIG. 5 to FIG. 10.

Figure 6:
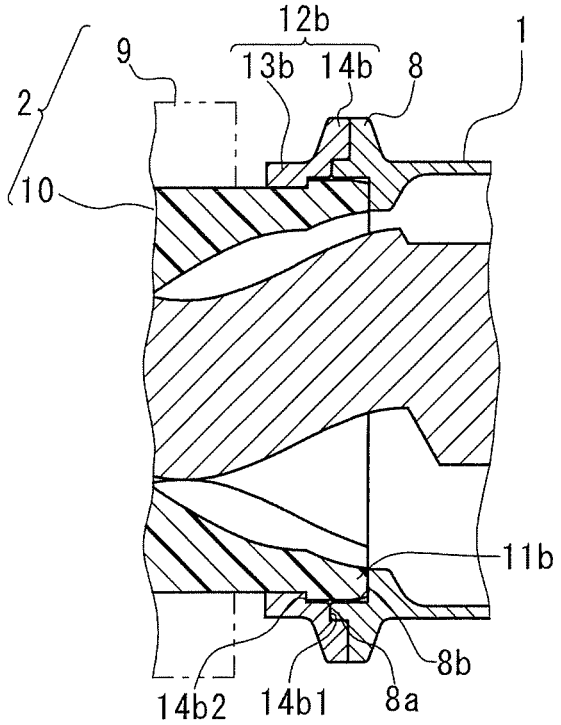
FIG. 6 is an enlarged cross-sectional view showing a state where the casing and the stator are connected to each other from the state shown in FIG. 5.
Figure 8:
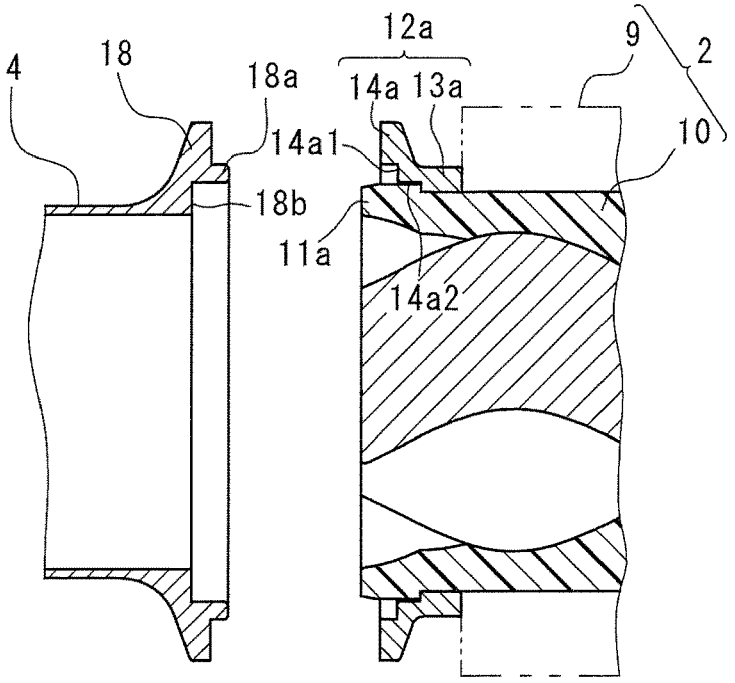
FIG. 8 is a partially-enlarged view showing a state where the stator and an end stud shown in FIG. 1(*b*) are in a disassembled state.
Figure 9:
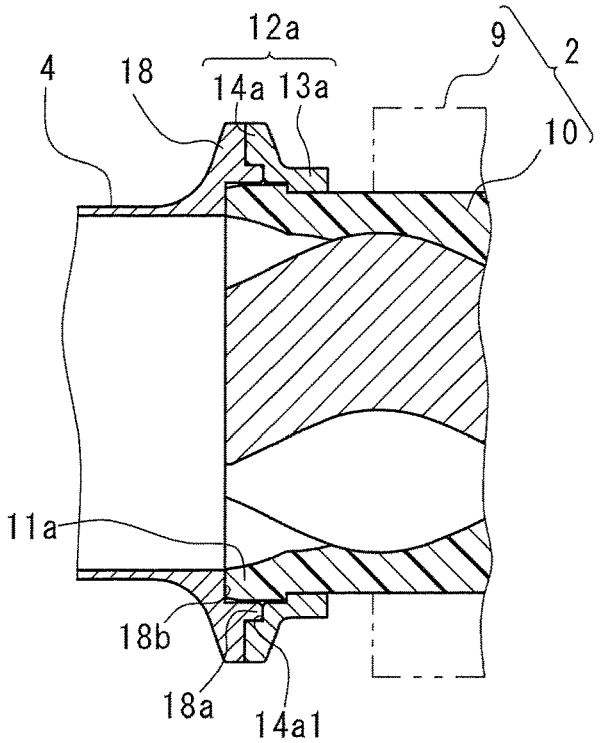
FIG. 9 is an enlarged cross-sectional view showing a state where the stator and the end stud are connected to each other from the state shown in FIG. 8.

In a state where the adaptors 12*a*, 12*b* are respectively mounted on both end portions of the stator body 10 which mounts the outer sleeve 9 on the outer peripheral portion thereof, as shown in FIG. 5 and FIG. 8, distal end portions of the ring portions 11*a*, 11*b* project from the flange portions 14*a*, 14*b* of the adaptors 12*a*, 12*b*. In such a state, the flange portion 8 of the casing 1 and the flange portion 18 of the end stud 4 are respectively brought into contact with end surfaces of the respective adaptors 12*a*, 12*b*. The ring portions 11*a*, 11*b* are positioned in the annular recessed portion 8*b* of the flange portion 8 and the annular recessed portion 18*b* of the flange portion 18, respectively. The annular projecting portion 8*a* of the flange portion 8 and the annular projecting portion 18*a* of the flange portion 18 are positioned in the first annular recessed portions 14*a*1, 14*b*1 of the flange portions 14*a*, 14*b*, respectively. Then, the ring portions 11*a*, 11*b* are press-fitted into the annular recessed portions 8*b*, 18*b* of the respective flange portions 8, 18 so that the ring portions 11*a*, 11*b* are elastically deformed, and portion of the elastic deformation brings about the displacement of the stator body 10 in the axial direction. Along with such displacement, as shown in FIG. 6 and FIG. 9, the outer sleeve 9 is separated from the adaptors 12*a*, 12*b*.

Figure 7:
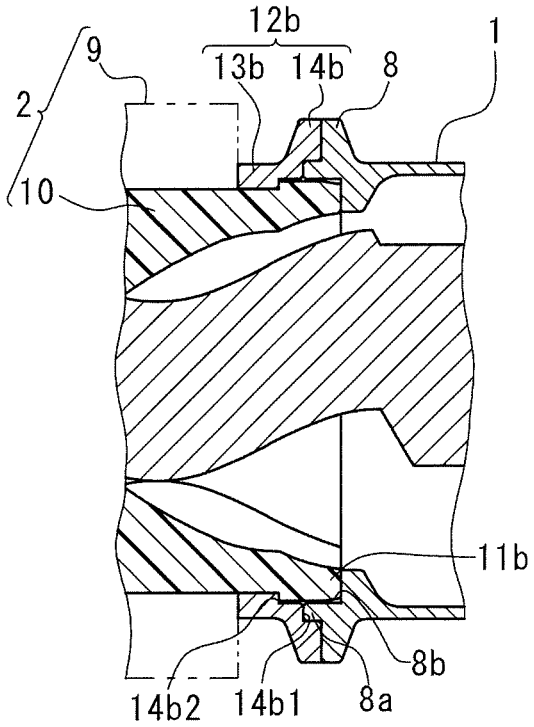
FIG. 7 is an enlarged cross-sectional view showing a state where the casing and the stator are fastened to each other by stay bolts from the state shown in FIG. 6.
Figure 10:
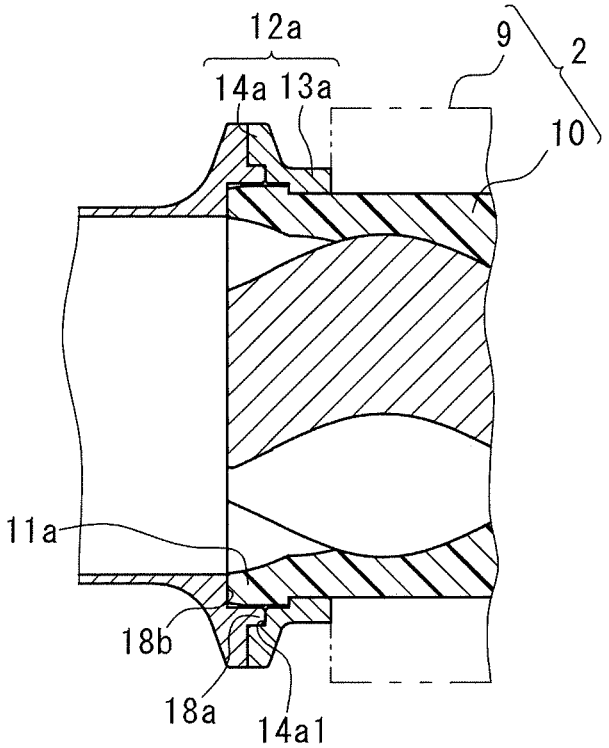
FIG. 10 is an enlarged cross-sectional view showing a state where the stator and the end stud are fastened to each other by stay bolts from the state shown in FIG. 9.

Subsequently, the first clamp 15 is mounted on the adaptor 12*a* and the flange portion 18, and the second clamp 16 is mounted on the adaptor 12*b* and the flange portion 8 respectively so as to strengthen the connection between the stator body 10 and the end stud 4 and the casing 1. Then, the nuts 22 are fastened to the stay bolt 19 so as to clamp the outer sleeve 9 between the casing 1 and the end stud 4 by way of the support members 20. With such an operation, as shown in FIG. 7 and FIG. 10, the stator body 10 is compressed in the axial direction. Therefore, the end surface of the ring portion 11*a* is brought into pressure contact with an inner end surface of the annular recessed portion 18*b* of the end stud 4. Further, the end surface of the ring portion 11*b* is brought into pressure contact with an inner end surface of the annular recessed portion 8*b* formed on the flange portion 8 of the casing 1. Accordingly, desired air-tightness can be ensured at the junctions and hence, both during a normal operation and during a cleaning operation, it is possible to prevent leakage of a liquid and intrusion of various germs brought about by the exposure of the junctions to ambient atmosphere.

Next, the manner of operation of the uniaxial eccentric screw pump having the above-mentioned configuration is described.

To discharge a fluid material from the tank and the like, the drive unit not shown is driven so as to rotate the rotor 3 by way of the coupling 6 and the coupling rod 5. The conveyance space 17 formed by an inner peripheral surface of the stator 2 and an outer peripheral surface of the rotor 3 moves in a longitudinal direction of the stator 2 and the rotor 3. Accordingly, the fluid material discharged from the tank is sucked into the conveyance space 17, and is conveyed to the end stud 4. After the fluid material reaches the end stud 4, the fluid material is further conveyed to another place.

In the uniaxial eccentric screw pump, when the conveyance of a fluid material is stopped, the fluid material remains in the stator 2. When the fluid material is kept remaining in the stator 2, there may arise a hygienically undesired situation. Further, there may also arise the case where the remaining fluid material adheres to the inner surface of the stator 2. Accordingly, cleaning and sterilization of the inside of the stator 2 are required. In this embodiment, it is possible to perform CIP (Cleaning in Place) where automatic cleaning is performed safely with a simple operation without disassembling production facility and SIP (Sterilizing in Place) where sterilization of equipment and piping is performed without disassembling equipment and piping from a state that the uniaxial eccentric screw pump was manufactured. Such operations can be performed hygienically because there is no possibility that various germs and the like in ambient atmosphere intrude into the stator 2.

For example, in the SIP, water vapor or pressurized hot water (hereinafter, collectively referred to as heated fluid) is supplied to the uniaxial eccentric screw pump, and the rotor 3 is rotated by driving the drive unit. At this stage of operation, the stator 2 through which the heated fluid passes thermally expands. As described previously, the stator 2 is formed of the stator body 10 made of a rubber material and the outer sleeve 9 disposed on an outer peripheral side of the stator body 10. Not only the stator body 10 but also the outer sleeve 9 is made of an expandable material. Accordingly, even when the stator body 10 expands toward an outer diameter side due to the heated fluid, the outer sleeve 9 also expands together with the stator body 10 so that there is no possibility that the deformation of the stator body 10 is obstructed. Accordingly, the expansion of the stator body 10 toward an inner surface side can be suppressed so that the rotation of the rotor 3 is not obstructed. That is, moving the conveyance space 17 by rotating the rotor 3 makes the heated fluid flow smoothly, thus cleaning and sterilizing the inner surface of the stator 2. During a cleaning operation, the outer sleeve 9 expands also in a longitudinal direction so that one end portion of the outer sleeve 9 is brought into pressure contact with the flange portion 8 of the casing 1, and the other end portion of the outer sleeve 9 is brought into pressure contact with the flange portion 18 of the end stud 4. Accordingly, sealing property at both end portions of the outer sleeve 9 can be enhanced.

After SIP is finished, the uniaxial eccentric screw pump is cooled with a lapse of time. In this case, both the stator body 10 and the outer sleeve 9 shrink together and return to original shapes so that the conveyance of a fluid material in an original form can be started again.

In this manner, according to the uniaxial eccentric screw pump of this embodiment, although the stator body 10 thermally expands with the supply of the heated fluid, the outer sleeve 9 which is disposed on the outer peripheral side of the stator body 10 also expands together with the stator body 10. Accordingly, it is possible to clean and sterilize the inner space by supplying the heated fluid without disassembling the uniaxial eccentric screw pump. It is unnecessary to disassemble the constitutional parts and hence, there is no possibility that various germs and the like contained in ambient atmosphere intrude into the inner space, and also there is no possibility that a sterilizing effect is impaired.

Further, the stator 2 can thermally expand at the time of performing cleaning or sterilization and hence, in a normal operation state where the stator 2 does not thermally expand, it is unnecessary to set a margin with respect to a gap formed between the inner surface of the stator body 10 and the outer surface of the rotor 3. Further, a contact pressure between the inner surface of the stator body 10 and the outer surface of the rotor 3 and an interference (overlapping between the inner surface of the stator body 10 and the outer surface of the rotor 3) can be set to desired values respectively. Accordingly, the conveyance of a fluid material during a normal operation can be performed efficiently at a desired discharge pressure.

The present disclosure is not limited to the configuration described in the above-mentioned embodiment, and various modifications are conceivable.

For example, in this embodiment, the uniaxial eccentric screw pump is disposed in a lateral direction (horizontal direction). However, by arranging the uniaxial eccentric screw pump in a longitudinal direction (vertical direction), a fluid material may be conveyed downward.

In this embodiment, the stator 2 is formed of the stator body 10 and the outer sleeve 9. However, the stator 2 may be formed of only the stator body 10. In this case, it is preferable that a distance between the casing 1 and the end stud 4 be maintained at a fixed distance by the stay bolts 19 each of which mounts the spacer 21 thereon. In such a configuration, the stator 2 is formed of only the stator body 10 and hence, even when a heated fluid flows in the stator 2, there is no possibility that the deformation of the stator 2 toward an outer diameter side is restricted. Accordingly, there is no possibility that the rotor 3 is brought into pressure contact with the inner surface of the stator 2 so that abnormal wear occurs on the stator 2. Further, sealing property between the stator 2 and the casing 1 and sealing property between the stator 2 and the end stud 4 can be maintained in a desired state at both end portions of the stator 2 and hence, leakage of a fluid material and intrusion of various germs from the outside can be prevented.

In the above-mentioned embodiment, although the support structure for the uniaxial eccentric screw pump, particularly, the support structure for the stator 2 is not particularly mentioned, the following configuration can be adopted.

Figure 3A:
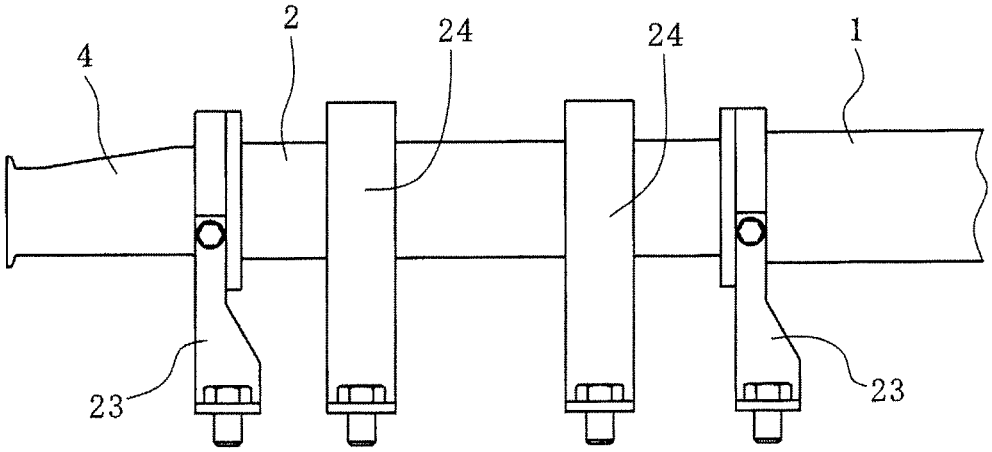
FIG. 3(*a*) is a schematic front view of a uniaxial eccentric screw pump according to another embodiment, FIG. 3(*b*) is a side view showing a first support frame, and FIG. 3(*c*) is a side view showing a second support frame.
Figure 3B:
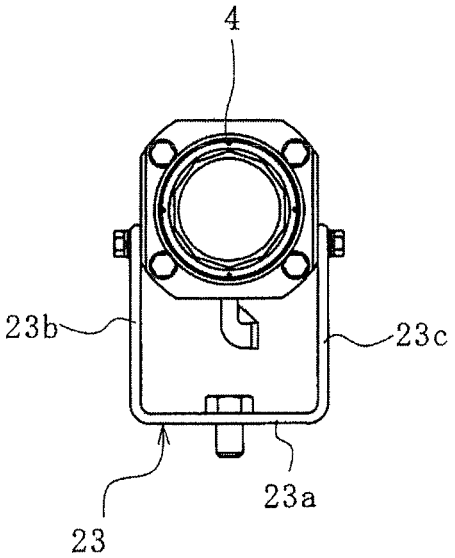
Figure 3C:
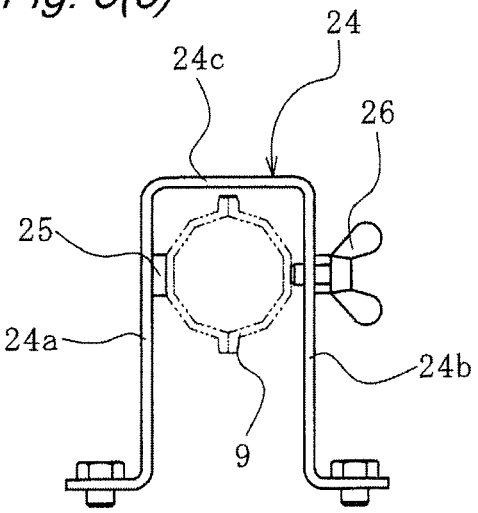

That is, as shown in FIG. 3, the end stud 4 and the casing 1 are supported by first support frames 23 fixed to a base respectively. The first support frame 23 is formed of a bottom surface portion 23*a*, and both side surface portions 23*b*, 23*c*. A center portion of the bottom surface portion is fixed to the base by a bolt, and bolts are threadedly engaged with the end stud 4 and the casing 1 by way of both side surface portions. The stator 2 is supported by second support frames 24 fixed to the base. The second support frame 24 is formed of both side surface portions 24*a*, 24*b* and an upper surface portion 24*c* which connects upper end portions of the side surface portions 24*a*, 24*b* to each other. Lower end portions of both side surface portions 24*a*, 24*b* are bent in horizontal direction and are fixed to the base by bolts. Further, a projecting portion 25 which is brought into contact with the outer sleeve 9 is integrally formed with an inner surface of one side surface portion. A wing screw 26 is threadedly engaged with the other side surface portion from an outer surface side, and a distal end portion of the wing screw 26 is brought into contact with the outer sleeve 9. By rotating the wing screw 26, a pressing force of the distal end portion of the wing screw 26 to the outer sleeve 9 can be adjusted.

Figure 4:
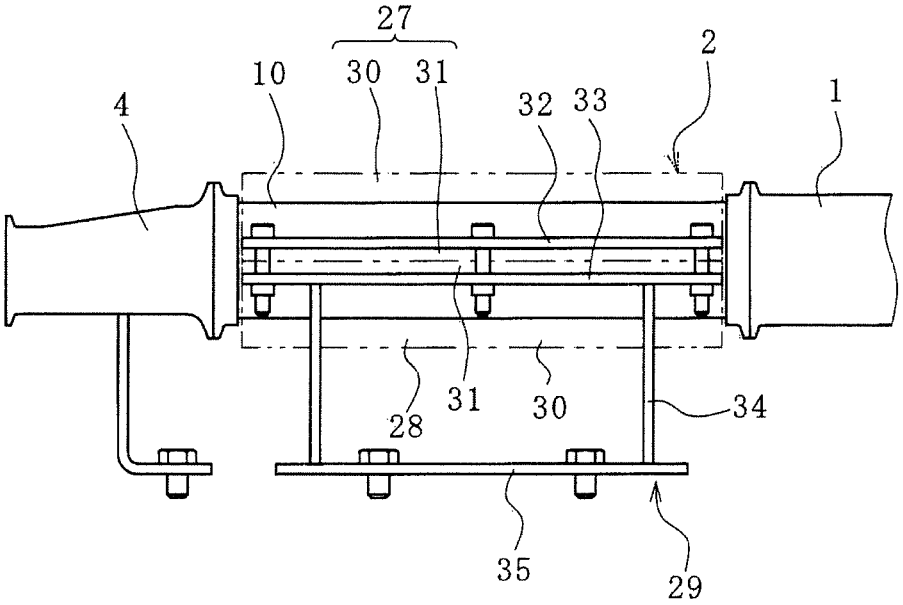
FIG. 4 is a schematic front view of a uniaxial eccentric screw pump according to another embodiment.

As shown in FIG. 4, an outer sleeve 9 may be formed of an upper half portion 27 and a lower half portion 28, and the upper half portion 27 and the lower half portion 28 may be held by a clamping member 29. Each of the upper half portion 27 and the lower half portion 28 is formed of a semicircular cylindrical portion 30 and extending portions 31 which extend sideward from both side edges of the semicircular cylindrical portion 30. The clamping member 29 includes an upper plate 32 and a lower plate 33 which are configured to clamp the extending portions 31 of the upper half portion 27 and the extending portions 31 of the lower half portion 28 in a state where the extending portions 31 of the upper half portion 27 and the extending portions 31 of the lower half portion 28 vertically overlap with each other. A mounting plate 35 is integrally formed with the lower plates 33 by way of connecting rods 34. The mounting plate 35 is fixed to the base by bolts. Bolts are made to pass through the upper plates 32 and the lower plates 33 of the clamping member 29 in a state where the upper plates 32 and the lower plates 33 clamp the extending portions 31 of the upper half portion 27 and the extending portions 31 of the lower half portion 28 of the outer sleeve 9 therebetween, and nuts are threadedly engaged with the bolts. By fastening the nuts, the upper half portion 27 and the lower half portion 28 of the outer sleeve 9 can be firmly fixed to each other.

DESCRIPTION OF SYMBOLS

1 Casing
2 Stator
3 Rotor
4 End stud
5 Coupling rod
6 Coupling
7 Connecting pipe
8 Flange portion
9 Outer sleeve
10 Stator body
11*a*, 11*b* Ring portion
12*a*, 12*b* Adaptor
13*a*, 13*b* Cylindrical portion
14*a*, 14*b* Flange portion
14*a*1, 14*b*1 First annular recessed portion
14*a*2, 14*b*2 Second annular recessed portion
15 First clamp
16 Second clamp
17 Conveyance space
18 Flange portion
19 Stay bolt
20 Support member
21 Spacer
22 Nut
23 First support frame
24 Second support frame
25 Projecting portion
26 Wing screw
27 Upper half portion
28 Lower half portion

29 Clamping member
30 Semicircular cylindrical portion
31 Extending portion
32 Upper plate
33 Lower plate
34 Connecting rod
35 Mounting plate

The invention claimed is:

1. A uniaxial eccentric screw pump comprising:

a casing;

a thermally expandable stator having a first end portion connected to the casing and a second end portion opposite to the first end portion, and having a stator body configured to expand in an outer diameter direction when heated fluid passes across an inner peripheral surface which is formed into a female threaded shape;

a rotor configured to be insertable into the stator and formed of a shaft body having a male threaded shape;

an end stud connected to the second end portion of the stator; and a closure structure separate from the stator body including a seal structure having:

a first flange portion formed on the second end portion of the stator and a second flange portion formed on the first end portion of the stator;

a third flange portion formed on the end stud and brought into contact with the first flange portion;

a fourth flange portion formed on the casing and brought into contact with the second flange portion;

a first clamp portion configured with a first pair of semicircular clamp portions to clamp the first flange portion to the third flange portion; and a second clamp configured with a second pair of semicircular clamp portions to clamp the second flange portion to the fourth flange portion.

2. The uniaxial eccentric screw pump according to claim 1, wherein the closure structure is configured to at least prevent intrusion of a foreign substance from outside the stator at a junction between the first end portion and the casing and at a junction between the second end portion and the end stud.

3. The uniaxial eccentric screw pump according to claim 2, wherein the stator body is made of a rubber material, and wherein the thermally expandable stator includes an outer sleeve disposed on an outer peripheral portion of the stator body in an adhesion state, and made of a resin material harder than the rubber material during a normal operation, and expands with the stator body when the stator body expands by heat.

4. The uniaxial eccentric screw pump according to claim 2, wherein the thermally expandable stator is formed of only the stator body.

5. The uniaxial eccentric screw pump according to claim 1, wherein the stator body is made of a rubber material, and wherein the thermally expandable stator includes an outer sleeve disposed on an outer peripheral portion of the stator body in an adhesion state, and made of a resin material harder than the rubber material during a normal operation, and expands with the stator body when the stator body expands by heat.

6. The uniaxial eccentric screw pump according to claim 1, wherein the thermally expandable stator is formed of only the stator body.

7. The uniaxial eccentric screw pump according to claim 1, wherein an adaptor made of a metal material is mounted to each of the first end portion and the second end portion of the thermally expandable stator, and the adaptors form the first flange portion and the second flange portion.

8. The uniaxial eccentric screw pump according to claim 1, wherein the seal structure includes a stay bolt which connects the casing and the end stud to each other.

9. The uniaxial eccentric screw pump according to claim 8, wherein the uniaxial eccentric screw pump includes a spacer which is mounted on the stay bolt from the outside, is brought into contact with the casing and the end stud, and maintains the casing and the end stud with a fixed distance therebetween.

10. The uniaxial eccentric screw pump according to claim 1, wherein the stator body is made of a rubber material, and wherein the thermally expandable stator includes an outer sleeve disposed on an outer peripheral portion of the stator body in an adhesion state, and made of a resin material harder than the rubber material during a normal operation, and expands with the stator body when the stator body expands by heat.

11. The uniaxial eccentric screw pump according to claim 1, wherein the first flange portion includes a first annular recessed portion, wherein the second flange portion includes a second annular recessed portion, wherein the third flange portion includes a first annular projecting portion, wherein the fourth flange portion includes a second annular projecting portion.

* * * * *